US009131306B2

(12) United States Patent
Bourgoin et al.

(10) Patent No.: US 9,131,306 B2
(45) Date of Patent: Sep. 8, 2015

(54) APPARATUS INCLUDING MEANS FOR CONNECTING TO ONE OR MORE OUTER SPEAKERS AS WELL AS MEANS FOR DETECTING SUCH A CONNECTION

(75) Inventors: Gilles Bourgoin, Rueil-Malmaison (FR); Patrice Pelin, Rueil-Malmaison (FR)

(73) Assignee: SAGEMCOM BROADBAND SAS, Rueil-Malmaison (FR)

( * ) Notice: Subject to any disclaimer, the term of this patent is extended or adjusted under 35 U.S.C. 154(b) by 553 days.

(21) Appl. No.: 13/515,799

(22) PCT Filed: Nov. 24, 2010

(86) PCT No.: PCT/EP2010/007106
§ 371 (c)(1), (2), (4) Date: Jun. 13, 2012

(87) PCT Pub. No.: WO2011/072795
PCT Pub. Date: Jun. 23, 2011

(65) Prior Publication Data

US 2012/0250894 A1 Oct. 4, 2012

(30) Foreign Application Priority Data

Dec. 18, 2009 (FR) ..... 09 06152

(51) Int. Cl.
*H04R 3/00* (2006.01)
*H04R 5/04* (2006.01)

(52) U.S. Cl.
CPC ..... *H04R 5/04* (2013.01); *H04R 2205/021* (2013.01); *H04R 2420/05* (2013.01); *H04R 2430/01* (2013.01)

(58) Field of Classification Search
CPC ..... H04R 5/04
USPC ..... 381/107, 59
See application file for complete search history.

(56) References Cited

U.S. PATENT DOCUMENTS 5,450,624 A 9/1995 Porambo et al.
6,870,934 B2 * 3/2005 Krochmal et al. ..... 381/59

FOREIGN PATENT DOCUMENTS

EP 1 133 211 A2 9/2001
EP 1 564 561 A1 8/2005
JP 2009171068 A * 7/2009

* cited by examiner

*Primary Examiner* — Sonia Gay
(74) *Attorney, Agent, or Firm* — Muncy, Geissler, Olds & Lowe, P.C.

(57) ABSTRACT

An audio appliance includes two external connections for connection to external loudspeakers, and includes means for establishing an electrical signal between the external terminals that is representative of an audio source in order to inject an excitation electric current into each external loudspeaker. Means are provided for incorporating a component at a "detection" frequency that is situated outside the audible spectrum in the electrical signal that is established between the external terminals, together with means for detecting an electric current flowing between the external terminals and having a frequency corresponding to the detection frequency. This is applicable in particular to systems comprising a mobile appliance and a fixed docking station incorporating a woofer and designed to receive the mobile appliance.

6 Claims, 3 Drawing Sheets

APPARATUS INCLUDING MEANS FOR CONNECTING TO ONE OR MORE OUTER SPEAKERS AS WELL AS MEANS FOR DETECTING SUCH A CONNECTION

BACKGROUND OF THE INVENTION

1. Field of the Invention

The invention relates to an appliance or terminal such as an audio reader appliance that is designed to be connected to one or more external loudspeakers in order to play back an audio source via the external loudspeakers.

2. Brief Discussion of the Related Art

Numerous portable appliances enable a wide variety of audio sources to be received and listened to, which sources come from a variety of origins: radio, telephone, television, recorded music, etc.

Given the small dimensions of such portable appliances, it is not possible to fit them with means that enable them to play back a high quality sound signal. In particular, the space available for loudspeakers is small, so the audio power and passband are necessarily limited on such appliances.

That is why it is known to provide a docking station that is fitted with additional loudspeakers for improving the sound rendering of the sound source read by the portable appliance, which docking station is generally fixed.

Specifically, the user merely engages the portable appliance in the docking station, with those two elements being provided with complementary electric connectors, thereby automatically causing the audio source to be played back via the additional loudspeakers fitted to the docking station.

In patent EP 1 564 561, proposals are made to detect the presence of additional loudspeakers by measuring the variation in the power supply current of the amplifier incorporated in the portable appliance that delivers the signal to the additional loudspeakers.

Nevertheless, that solution is found to be relatively expensive to implement in order to obtain detection of sufficient reliability: it requires the power supply current to be characterized and stored in the appliance, and it also requires current measuring means of relatively high accuracy.

SUMMARY OF THE INVENTION

The object of the invention is to propose a solution enabling the connection of external loudspeakers to an appliance such as a portable appliance to be detected in a manner that is reliable and inexpensive.

To this end, the invention provides an audio appliance comprising at least one audio output including at least two external terminals for connection to one or more external loudspeakers for playing back via each external loudspeaker a sound signal corresponding to an audio source amplified by the appliance, the appliance including means for establishing between the external terminals an electrical signal representative of the audio source for injecting an electric current into each connected external loudspeaker, wherein the appliance includes means for incorporating an electrical signal component having a "detection" frequency that lies outside the audible frequency spectrum in the electrical signal established between its external terminals, and also means for detecting an electric current flowing between the external terminals and having a frequency situated outside the audible frequency spectrum.

With this solution, it is possible, at lower cost, to detect that external loudspeakers are connected, and to do so in a manner that is reliable.

The invention also provides an appliance as defined above, including a class D amplifier for amplifying the sound source, and in which the component of the electrical signal having the detection frequency as its frequency is generated directly by the class D amplifier, the detection frequency corresponding to the sampling frequency of the class D amplifier.

The invention also provides an appliance as defined above, wherein the means for detecting a current flowing between the external terminals comprise an inductor tuned to the detection frequency and connected between an amplifier of the appliance and one of the external terminals, together with means for measuring the voltage across the terminals of said inductor.

The invention also provides an appliance as defined above, having a plurality of audio outputs together with detector means associated with each of the audio outputs.

The invention also provides a system including an appliance as defined above, together with external loudspeakers for connection to the appliance via the external terminals, and in which the appliance includes means for acting, in the event of external loudspeakers being detected, to reduce the gain of the signal in the frequency band that is common to the internal loudspeakers and to the external loudspeakers.

The invention also provides a system including an appliance as defined above, together with external loudspeakers for connection to the appliance via the external terminals of the appliance, and in which each external loudspeaker includes a capacitor connecting together its connection terminals.

DETAILED DESCRIPTION OF THE PREFERRED EMBODIMENTS

The idea on which the invention is based is to incorporate a component having a so-called "detection" frequency that is greater than or lower than audible frequencies in the amplified electrical signal that is applied to the external terminals and that is representative of the audio source read by the appliance, and to determine that loudspeakers are connected when a current is established between the external terminal at the frequency corresponding to the detection frequency, or more generally at a frequency lying outside the audible frequency spectrum.

Figure 1:
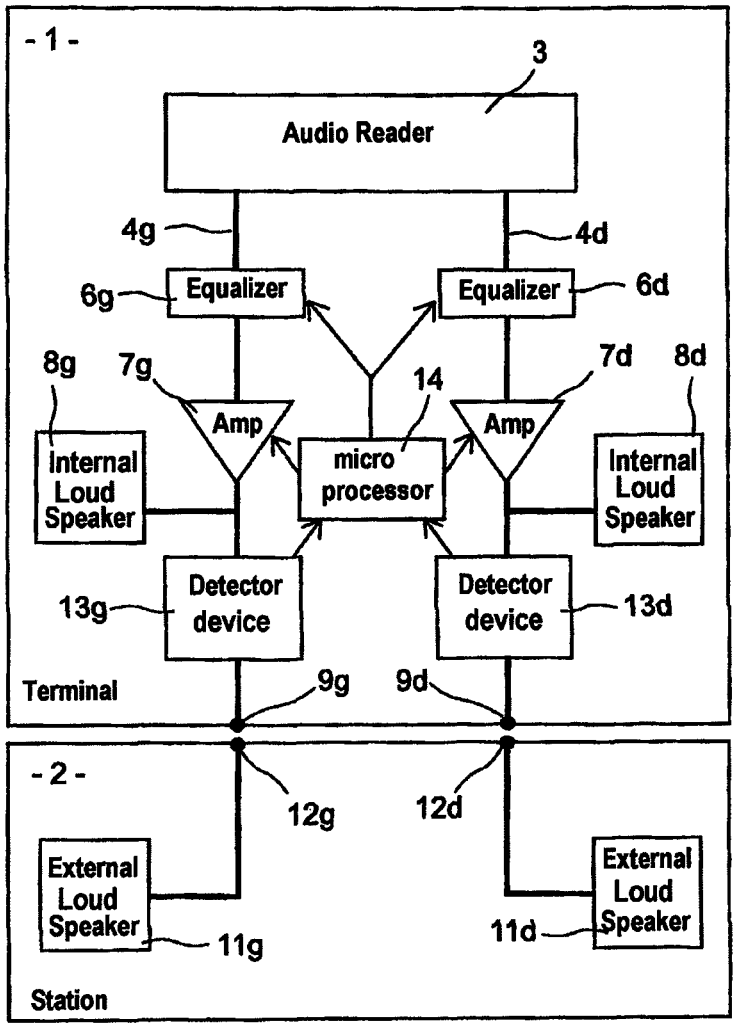
FIG. 1 is a diagram of a portable appliance electrically connected to a fixed docking station incorporating additional loudspeakers.

The system of the invention is shown diagrammatically in FIG. 1 and comprises an appliance forming a mobile player terminal, referenced 1, associated with a fixed docking station referenced 2 in which the mobile appliance is engaged.

The appliance 1 includes a reader unit 3 for reading an audio source, which unit delivers two electrical signals, respectively on two channels 4*g* and 4*d* corresponding in this example to the right and left channels of a stereophonic source.

As visible in FIG. 1, the line 4*g* includes an equalizer 6*g* that receives as input the left signal from the reader 3, and that delivers an equalized signal to an amplifier 7*g* for the left channel.

The amplified signal is applied both to a left loudspeaker 8*g* that is incorporated in the appliance 1, and also to an external connector 9*g* whereby the appliance may optionally be connected to a left loudspeaker 11*g* that is external and fitted to the docking station 2. A loudspeaker detector device for the left channel is referenced 13*g* and is interposed between the amplifier 7*g* and the external connector 9*g*.

In analogous manner, the right channel 4*d* is provided with an equalizer 6*d*, an amplifier 7*d*, a loudspeaker 8*d*, and a detector device 13*d* interposed between the amplifier 7*d* and the external connector 9*d* of the right channel.

In the device of FIG. 1, the left external loudspeaker 11*g* is electrically connected to the external connector 9*g* of the left channel via a left connector 12*g* forming part of the docking station, and in analogous manner, the right external loudspeaker 11*d* is electrically connected to the right external connector 9*d* by a right connector 12*d* also fitted to the docking station.

As can be seen in FIG. 1, the appliance 1 also includes a microprocessor or microcontroller 14 that communicates with the detector devices 13*g* and 13*d*, with the amplifiers 7*g* and 7*d*, and with the equalizers 6*g* and 6*d*, in order to control them.

Each amplifier 7*g* and 7*d* is a class D amplifier. Such an amplifier delivers a squarewave output signal of constant amplitude at a so-called "sampling" frequency that is much higher than the frequencies of the audible spectrum. The amplifier modulates the duty ratio of the squarewave signal as a function of the amplitude of the signal from the sound source being read.

In other words, the duty ratio is high when the audio source signal has a high value, and the duty ratio is low when the audio source signal is low. Since the sampling frequency of the amplifier is much higher than audible frequencies, the value of the signal output at any given instant corresponds to the value of the duty ratio at that instant.

Under such conditions, the output signals of the left channel and of the right channel each present a component of frequency that corresponds to the sampling frequency, which frequency is greater than audible frequencies, and that constitutes a so-called "detection" frequency in this example.

In practice, when the loudspeaker 11*g* is connected to the appliance 1, the electrical signal delivered by the amplifier 7*g* on the left channel 4*g* gives rise to an electric current having the same appearance as the signal, this current thus flowing between the terminals of the connector 9*g* on being injected into the loudspeaker 11*g*.

When the amplifiers of the appliance are not class D amplifiers, it is possible to inject into the output signal a component at a frequency that lies outside the audible frequency spectrum, e.g. by means of an additional electronic component or circuit connected to the output terminals of the appliance.

Either way, whatever the appearance of the sound source read by the appliance 1, the current injected into the loudspeaker 11*g* when it is connected includes a component at a frequency that is the detection frequency.

The detector device 13*g* detects whether the loudspeaker 11*g* is actually connected by determining whether an electric current having a component of frequency close to the detection frequency is or is not flowing between the terminals of the connector 9*g*. The same applies to the detector device 13*d* detecting whether or not the loudspeaker 11*d* is actually connected.

In general, the detector device is arranged to identify the existence of current components at frequencies lying outside the audible spectrum. By way of example, the device may merely correspond to a highpass type filter serving to pass currents at frequencies higher than the audible spectrum for identification purposes.

Figure 2:
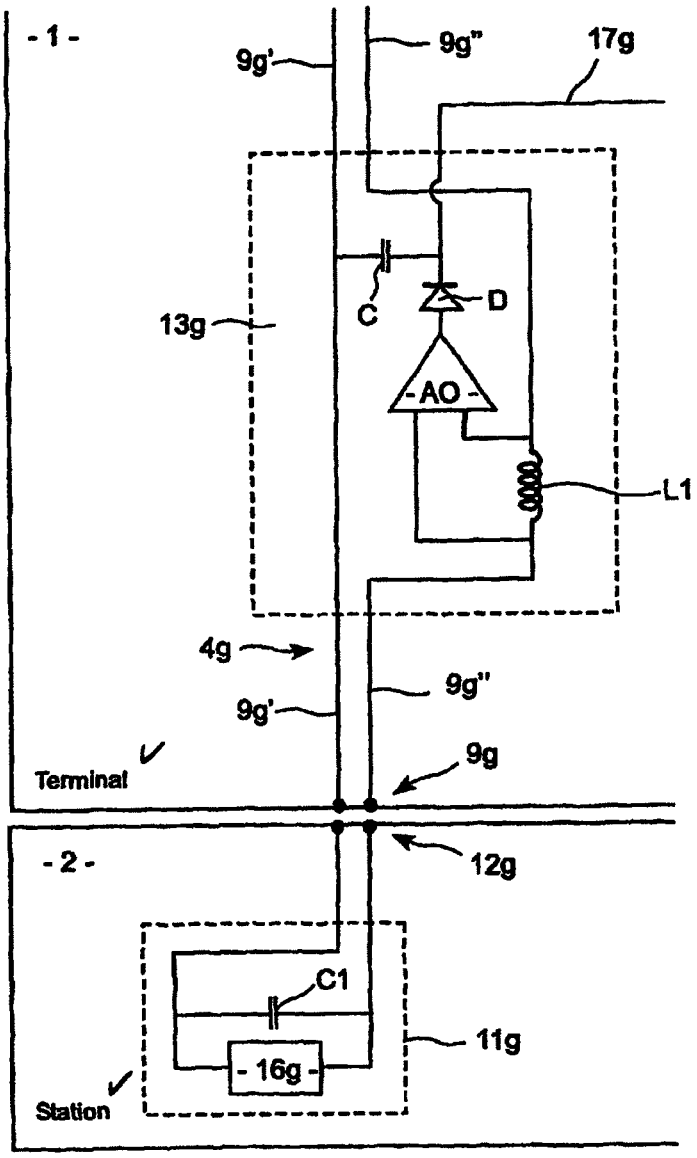
FIG. 2 is a diagram of additional loudspeaker detector means incorporated in the mobile appliance.

As can be seen in FIG. 2, the detector device 13*g* mainly comprises an inductor L1, an operational amplifier AO, a diode D, and a capacitor referenced C.

More particularly, and as shown in FIG. 2, the left channel 4*g* comprises a first line 9*g*' and a second line 9*g*", each connected to a corresponding output terminal of the connector 9*g*.

The inductor L1 is interposed between two consecutive portions of the line 9*g*", i.e. it is connected in series in said line. The operational amplifier AO has its two inputs connected to the terminals of the inductor L1, and its output connected to an output line 17*g* via the diode D that is oriented to allow current to pass only in the direction leaving the operational amplifier. The capacitor C is connected firstly to the output from the diode D and secondly to the line 9*g*'.

The operational amplifier AO amplifies the voltage across the terminals of the inductive coil L1, which, for example, is tuned to the detection frequency, and the diode D in association with the capacitor C forms a detector circuit with its output 17*g* going to the microcontroller 14. The signal delivered on the output line 17*g* is thus representative of the connected or non-connected state of a loudspeaker on the external connector 9*g*.

This signal has a large amplitude when an external loudspeaker is connected to the connector 9*g*, and an amplitude that is substantially zero if no loudspeaker is connected. Because of the diode D, the detection signal on the line 17*g* includes positive values only.

As can be seen in FIG. 2, the left external loudspeaker 11*g* comprises a transducer 16*g* connected to the terminals of the connector 12*g*, and it is also fitted with an additional capacitor C1 connected across the terminals of the connector 12*g*.

The inductance of the inductor L1 and the capacitance of the capacitor C1 are selected so as to avoid modifying the passband of the audio signal, given that in practice the inductance of L1 is a few microhenries, and the capacitance of the capacitor C1, which is optional, is a few nanofarads. To give an order of magnitude, the maximum frequency of the audible spectrum is 20 kilohertz (kHz), whereas the sampling frequency of the amplifier 7*g* is 500 kHz.

The outlet 17*g* from the detector device 13*g* is connected to the processor 14, as shown diagrammatically in FIG. 1, and the same applies to the output from the detector device 13*d*. Furthermore, the microprocessor 14 is connected to the amplifiers 7*g* and 7*d* and also the equalizers 6*g* and 6*d* so as to control them depending on whether or not external loudspeakers are connected.

Thus, when connection to external loudspeakers 11*g* and 11*d* is detected by the devices 13*g* and 13*d*, the microprocessor 14 controls the amplifiers 7*g* and 7*d* to reduce significantly the amplification gain applied to the audio source. This serves to avoid an increase in the sound volume of the audio source being played back as a result of connection to the external loudspeakers, thereby making the system more ergonomic since the user does not need to perform this volume correction manually.

In practice, the reader appliance 1 and the docking station 2 are associated with each other and the detection of connection to the external loudspeakers 11*g* and 11*d* is used in order to adapt the equalization that is applied to the audio source when the external loudspeakers are connected.

With such a system, the internal loudspeakers and the external loudspeakers have passbands that overlap. For example, the internal loudspeakers have a passband extending from 250 hertz (Hz) to 16 kHz, and the external loudspeakers fitted to the docking station have a passband extending from 31 Hz to 500 Hz, the docking station then constituting a woofer.

Figure 3:
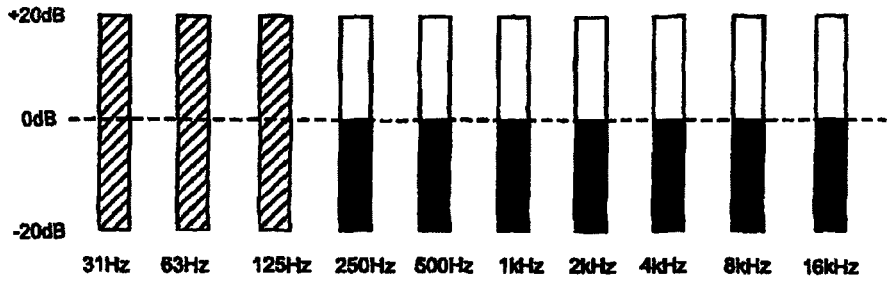
FIG. 3 shows an example of the equalization applied by the appliance in the absence of connected external loudspeakers.

As shown diagrammatically in FIG. 3, the appliance 1 may be provided with an interface, e.g. a graphical interface, enabling it to adjust equalization gains in frequency bands.

If no external loudspeaker is detected, only gains lying in the passband of the internal loudspeakers can be adjusted by the user, as shown diagrammatically in FIG. 3. Under such circumstances, only the gains at frequencies lying in the range 250 Hz to 16 kHz are displayed, while the gains for frequencies lying in the range 31 Hz to 125 Hz that lie outside the passband of the internal loudspeakers are shaded to show that these gains cannot be adjusted.

When the appliance 1 detects that external loudspeakers are connected, the low frequency gain corresponding to the external loudspeakers are then displayed in such a manner as to enable the user to adjust them to the user's taste.

Additionally, when external loudspeakers are detected, the microprocessor 14 corrects the existing equalization so as to compensate for the fact that the passbands of the internal and external loudspeakers overlap. Specifically, the microprocessor 14 then causes the equalizers 6*g* and 6*d* to lower by 2 decibels (dB) the gains of the frequencies 250 Hz to 500 Hz that correspond to the overlap zone of the passbands of the internal and external loudspeakers.

Figure 4:
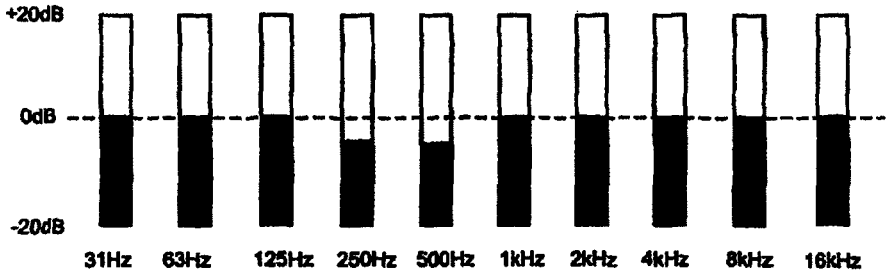
FIG. 4 shows the equalization correction applied to the FIG. 3 equalization when connection to external loudspeakers is detected.

Thus, as shown in FIG. 4, starting from flat equalization as shown in FIG. 3, in which each gain is zero, connecting external loudspeakers automatically causes the gains at 250 Hz and 500 Hz to be corrected so as to take on values of −2 db.

In general, the detection that external loudspeakers are actually connected can be used for adapting the signal processing parameters to the types of the loudspeakers via which the sound source is being played back, or indeed to inform the user about faulty connections.

Various effects such as loudness, physiological correction, or indeed an audio spatialization effect may thus be activated on detecting actual connection of external loudspeakers.

For appliances of the home cinema type, various audio outputs are provided that have differing characteristics, e.g. one output for a woofer, and another output for loudspeakers that should be situated behind the listener. The invention then makes it possible to detect which outputs actually have a loudspeaker connected thereto in order to adapt the way the signal is processed to the actual situation.

Detection is advantageously performed on each output of the appliance that is designed to be connected to a loudspeaker, thereby making it possible in particular to inform the user, via the interface of the reader appliance, of a faulty connection concerning the external loudspeakers.

In the example shown in the figures, the invention is applied to a mobile appliance that is designed to co-operate with a fixed station, however the invention applies to other types of appliance. It applies more generally to audio and possibly video reproduction devices that are of a portable type such as telephones, electronic organizers, laptop computers, which devices are associated with fixed stations enabling the quality of sound rendering to be improved.

The invention also applies to audio reproduction devices such as TVs, DVD readers, or the like, that possess one or more audio outputs leading to loudspeakers.

The invention also applies to systems in which the audio reproduction device has connections to loudspeakers that are difficult to access, such as in a motor vehicle, for example, or in an auditorium, where the invention makes it possible to detect a loss of connection to a loudspeaker.

What is claimed is:

1. An audio appliance comprising at least one audio output including at least two external terminals for connection to one or more external loudspeakers for playing back via each external loudspeaker a sound signal corresponding to an audio source amplified by the appliance, the appliance including means for establishing between the external terminals an electrical signal representative of the audio source for injecting a corresponding electric current into each connected external loudspeaker, the appliance including means for incorporating an electrical signal component having a "detection" frequency that lies outside the audible frequency spectrum in the electrical signal established between its external terminals, and also means for detecting an electric current flowing between the external terminals and having a component of frequency that corresponds to the detection frequency, wherein the appliance includes a class D amplifier for amplifying the sound source, and in which the component of the electrical signal having the detection frequency as its frequency is generated directly by the class D amplifier, the detection frequency corresponding to a sampling frequency of the class D amplifier.

2. The appliance according to claim 1, wherein the means for detecting a current flowing between the external terminals comprise an inductor tuned to the detection frequency and connected between an amplifier of the appliance and one of the external terminals, together with means for measuring the voltage across the terminals of said inductor.

3. The appliance according to claim 1, having a plurality of audio outputs together with detector means associated with each of the audio outputs.

4. The appliance according to claim 1, including internal loudspeakers fed with the same electrical signal as the external terminals, and means for decreasing the amplitude of the electrical signal if external loudspeakers are detected as being connected to the external terminals.

5. The system comprising an appliance as defined in claim 1, together with external loudspeakers for connection to the appliance via the external terminals, and in which the appliance includes means for acting, in the event of external loudspeakers being detected, to reduce the gain of the signal in the frequency band that is common to internal loudspeakers of the appliance and to the external loudspeakers.

6. The system including an appliance as defined in claim 1, together with external loudspeakers for connection to the appliance via the external terminals of the appliance, and in which each external loudspeaker includes a capacitor connecting together its connection terminals.

* * * * *